US008809709B2

(12) United States Patent
Watanabe

(10) Patent No.: US 8,809,709 B2
(45) Date of Patent: Aug. 19, 2014

(54) PUSH SWITCH

(71) Applicants: Citizen Electronics Co., Ltd., Yamanashi (JP); Citizen Holdings Co., Ltd., Tokyo (JP)

(72) Inventor: Shinsuke Watanabe, Yamanashi (JP)

(73) Assignees: Citizen Electronics Co., Ltd., Yamanashi (JP); Citizen Holdings Co., Ltd., Tokyo (JP)

( * ) Notice: Subject to any disclaimer, the term of this patent is extended or adjusted under 35 U.S.C. 154(b) by 0 days.

(21) Appl. No.: 14/128,591

(22) PCT Filed: Feb. 22, 2013

(86) PCT No.: PCT/JP2013/054607
§ 371 (c)(1), (2), (4) Date: Dec. 20, 2013

(87) PCT Pub. No.: WO2013/125706
PCT Pub. Date: Aug. 29, 2013

(65) Prior Publication Data

US 2014/0151213 A1 Jun. 5, 2014

(30) Foreign Application Priority Data

Feb. 23, 2012 (JP) ..... 2012-037285

(51) Int. Cl.
*H01H 5/18* (2006.01)

(52) U.S. Cl.
USPC ..... 200/294; 200/513; 200/406

(58) Field of Classification Search
USPC ..... 200/535, 534, 520, 521, 512, 513, 406, 200/294, 341
See application file for complete search history.

(56) References Cited

U.S. PATENT DOCUMENTS

| | | | | |
|---|---|---|---|---|
| 6,100,484 | A * | 8/2000 | Houze et al. | 200/512 |
| 6,489,580 | B2 * | 12/2002 | Yanai et al. | 200/406 |
| 7,576,291 | B2 * | 8/2009 | Tseng et al. | 200/296 |
| 7,906,741 | B2 * | 3/2011 | Yanai et al. | 200/406 |
| 8,455,778 | B2 * | 6/2013 | Yang et al. | 200/406 |

FOREIGN PATENT DOCUMENTS

| | | | |
|---|---|---|---|
| JP | 2004-79220 | A | 3/2004 |
| JP | 2005-353563 | A | 12/2005 |
| JP | 2010-20911 | A | 1/2010 |
| JP | 2011-100549 | A | 5/2011 |
| JP | 2011-150870 | A | 8/2011 |

OTHER PUBLICATIONS

International Search Report for PCT/JP2013/054607, Mar. 19, 2013.
Japan Patent Office, Japanese Office Action for Japanese Patent Application No. 2013-215015, May 20, 2014.

* cited by examiner

*Primary Examiner* — Felix O Figueroa

(57) ABSTRACT

Provided is a pushbutton switch that can be made thin without requiring that a notch be made into a mounting board. The pushbutton switch is provided with a first substrate having a housing recess part located on a surface of the first substrate, a center contact provided at roughly the center of the interior of the housing recess part, a pair of peripheral contacts provided on peripheral edge parts of the housing recess part, a movable contact spring that is installed on the pair of peripheral contacts and that touches the center contact upon being pressed, and a second substrate, which is provided with a pair of connection pads electrically connected to the first substrate. A cross section of the first and second substrates is formed as a whole into an "L"-like shape.

4 Claims, 4 Drawing Sheets

PUSH SWITCH

TECHNICAL FIELD

The present invention relates to a push switch, and more specifically to a push switch that is advantageous for use, for example, as an operating button or the like on a mobile telephone.

BACKGROUND

As electronic products such as mobile telephones have been reduced in size and thickness, operating buttons used in such products have also been reduced in size. Traditionally, dome-shaped push switches have been employed for many such electronic products. In recent years, the overall switch size including the switch thickness has been further reduced, and work on further reducing the switch height has also been proceeding for side-mounted switches, i.e., switches mounted on side faces of mounting substrates such as circuit substrates.

For example, patent document 1 discloses a push-on switch for mounting on a circuit substrate wherein the circuit substrate is provided with a U-shaped cutout that matches the size of the body part of the switch case, the design being such that the push-on switch with its operating part facing forward is mounted by fitting the body part into the cutout from above the circuit substrate. This push-on switch achieves a reduction in switch thickness in the mounted condition by sinking the body part of the switch into the cutout.

PRIOR ART DOCUMENT

Patent Document

Patent document 1: Japanese Unexamined Patent Publication No. 2011-150870

SUMMARY

In the push-on switch disclosed in patent document 1, a cutout is formed in the mounting substrate. However, there are cases where such cutouts cannot be formed, and therefore there is a need for a switch that can be mounted without requiring the provision of a cutout and that can, at the same time, be reduced in thickness.

Furthermore, the push-on switch disclosed in patent document 1 uses a switch case in which contacts and terminals are insert-molded. However, the method of molding the switch case by embedding metal parts such as contacts and terminals therein has had the problem that it is difficult to further reduce the overall size of the switch.

Another possible method for reducing switch thickness has been to attach a flexible printed circuit board (FPC) with a push switch mounted thereon to a side face of a mounting substrate, but this method has had the problem that the use of a FPC increases the material and fabrication costs.

An object of the present invention is to provide a push switch that resolves the above deficiencies.

Another object of the present invention is to provide a push switch that can be reduced in thickness without requiring the provision of a cutout in a mounting substrate.

A further object of the present invention is to provide a push switch that can be reduced in thickness without requiring the provision of a cutout in a mounting substrate, and at the same time can decrease material and fabrication costs.

A push switch includes a first substrate having an accommodating recess on a front surface thereof, a center contact provided so as to be substantially centralized in the accommodating recess, a pair of peripheral contacts each provided at a circumferential edge of the accommodating recess, a movable contact spring constructed so as to extend across the pair of peripheral contacts and designed to be brought into contact with the center contact when pressed, and a second substrate having a pair of connection pads electrically connected to the first substrate, and wherein the first substrate and the second substrate are formed as an integral structure so as to provide an L-shaped cross section.

A push switch includes a first substrate having an accommodating recess on a front surface thereof, a center contact provided in the center of the accommodating recess, a pair of peripheral contacts provided at inner circumferential edges of the accommodating recess so as to oppose each other across the center contact, a movable contact spring as a raised dome-shaped thin metal plate formed so as to extend across the pair of peripheral contacts and designed to be elastically depressed under pressure and brought into contact with the center contact, a flexible supporting sheet bonded to the first substrate so as to close an opening of the accommodating recess, and a second substrate mounted perpendicular to the first substrate by bonding a side face thereof to a back surface of the first substrate, the first and second substrates together forming a structure having an L-shaped cross section, and wherein the first substrate has a pair of electrically conductive back surface patterns formed on the back surface thereof, one being electrically connected to the center contact or the other to the peripheral contacts via a through-hole formed passing through the front and back surfaces, and the second substrate has a pair of electrode pads formed on the back surface thereof, each electrode pad being electrically connected to a corresponding one of the back surface patterns via a pair of electrically conductive connection patterns formed at least on the side face thereof.

Preferably, in the push switch, the first substrate has a pair of electrically conductive back surface patterns on a back surface thereof, the center contact is electrically connected to one of the pair of back surface patterns, the pair of peripheral contacts is connected to the other one of the pair of back surface patterns, and the second substrate has a pair of electrically conductive connection patterns on a side face thereof for connecting to the pair of back surface patterns formed on the first substrate, and a pair of connection pads each electrically connected to a corresponding one of the pair of electrically conductive connection patterns, wherein the first substrate and the second substrate are bonded together by bonding the back surface of the first substrate to the side face of the second substrate to form the integral structure having the L-shaped cross section, and the integral structure is mounted on a side edge of a mounting substrate.

In the push switch, the second substrate is mounted perpendicular to the first substrate by bonding the side face thereof to the back surface of the first substrate, the first and second substrates together forming a structure having an L-shaped cross section, and the second substrate includes the pair of electrode pads formed on the back surface thereof, each electrode pad being electrically connected to a corresponding one of the back surface patterns via the pair of electrically conductive connection patterns formed at least on the side face thereof; accordingly, the first and second substrates can each be formed using a conventional printed circuit board (PCB), which not only facilitates the construction of a thin structure but also makes it possible to reduce the overall cost. That is, since the electrical connections between the first and second substrates are made via the through-holes, the electrically conductive back surface patterns, the connection patterns, and the electrode pads, it is possible to enhance mass-producibility and further reduce the size and thickness, compared with the prior art method that provides electrical connections by insert-molded metal parts. Furthermore, the push switch has higher stiffness than in the case of the FPC or the like, and has higher strength with respect to the switch pressing force.

Preferably, the push switch further includes a substrate bonding sheet interposed between the first substrate and the second substrate, wherein the substrate bonding sheet includes connection apertures provided in corresponding fashion to portions where the pair of back surface patterns on the first substrate is connected to the pair of electrically conductive connection patterns on the second substrate. In the push switch, the presence of the substrate bonding sheet not only serves to further enhance the adhesion between the regions around the connecting portions, and but also provides waterproof sealing to the electrical connection portions between the first and second substrates.

Preferably, the push switch further includes a thickness adjusting plate-like spacer which is bonded to the second substrate and whose surface height is adjusted so as to achieve a surface flush with the side face of the first substrate. In the push switch, the switch height can be changed by changing the thickness of the second substrate and the plate-like spacer, and thus it is possible to readily address various needs for the switch height.

Preferably, the push switch further includes a flexible supporting sheet bonded to the first substrate so as to close the opening of the accommodating recess, and a protrusion provided on a front surface of the supporting sheet at a position corresponding to a crest of the movable contact spring. In the push switch, since the center of the switch can always be pressed in a reliable manner, not only a stable operating feel but also prolonged service life can be obtained. Further, the push switch as a side-mounted switch can achieve performance (operating characteristics and service life) comparable to that of a surface-mounted switch.

The push switch can be easily constructed in a thin structure, and the overall cost can be reduced by using inexpensive PCBs or the like. Further, since there is no need to provide a cutout in the mounting substrate, not only can greater freedom be provided in the design of the mounting substrate and the placement of the switch, but the material and fabrication costs can also be reduced.

DESCRIPTION

Figure 1:
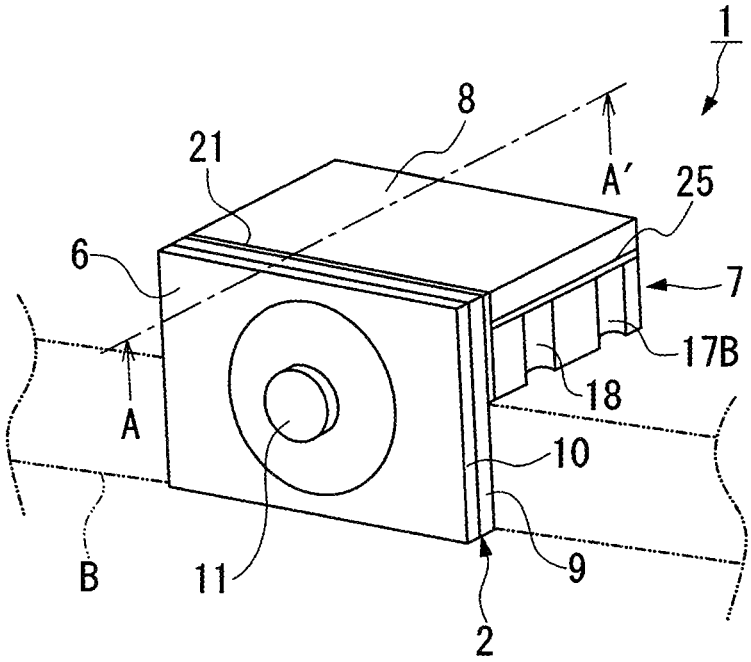
FIG. 1 is a perspective view of a push switch 1.

A push switch will be described below with reference to the drawings. It will, however, be noted that the technical scope of the present invention is not limited by any particular embodiment described herein but extends to the inventions described in the appended claims and their equivalents. Further, throughout the drawings, the same or corresponding component elements are designated by the same reference numerals, and the description of such component elements, once given, will not be repeated thereafter.

Figure 2:
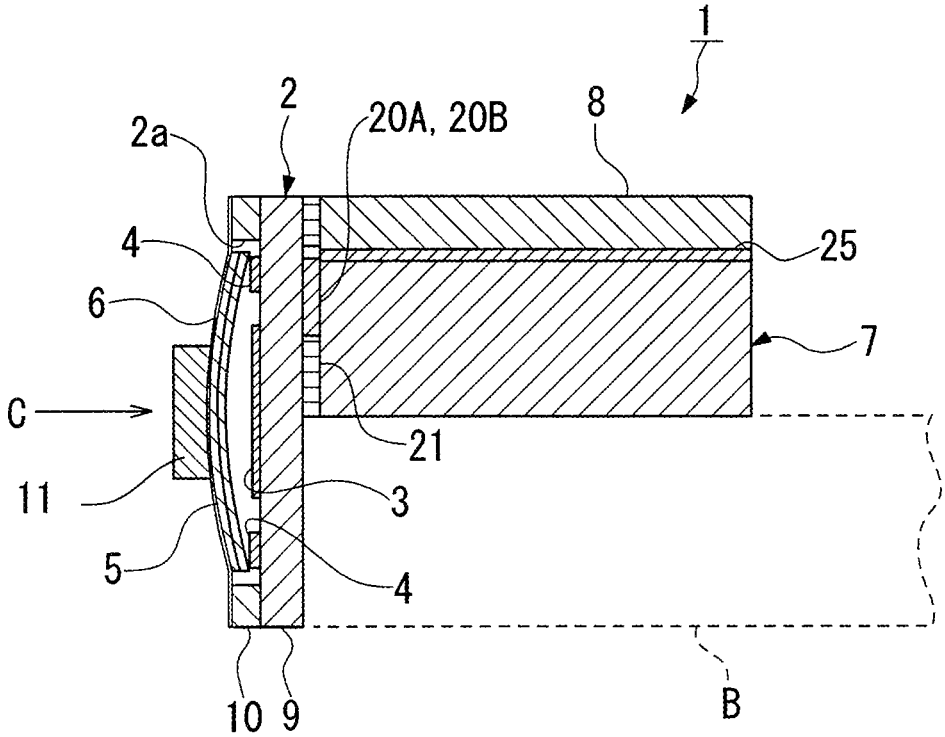
FIG. 2 is a cross-sectional view taken along line AA' in FIG. 1.

FIG. 1 is a perspective view of a push switch 1, and FIG. 2 is a cross-sectional view taken along line AA' in FIG. 1.

As shown in FIGS. 1 and 2, the push switch 1 is mounted on a side edge of a mounting substrate B. The push switch 1 includes a first substrate 2 having an accommodating recess 2*a* on the front surface thereof, a center contact 3 provided in the center of the accommodating recess 2*a*, and a pair of peripheral contacts 4 provided at inner circumferential edges of the accommodating recess 2*a* so as to oppose each other across the center contact 3. The push switch 1 further includes a movable contact spring 5 as a raised dome-shaped thin metal plate formed so as to extend across the pair of peripheral contacts 4 and designed to be elastically depressed under pressure and brought into contact with the center contact 3, and a flexible supporting sheet 6 bonded to the first substrate 2 so as to close the opening of the accommodating recess 2*a*. The push switch 1 further includes a second substrate 7 mounted perpendicular to the first substrate 2 by bonding a side face thereof to the back surface of the first substrate 2, and a thickness adjusting plate-like spacer 8 bonded to the second substrate 7 and disposed so as to achieve a surface flush with a side face of the first substrate 2. As shown in FIG. 2, the first and second substrates 2 and 7 are mounted on the side edge of the mounting substrate B so that the two substrates together form a structure having a substantially L-shaped cross section. In FIG. 2, the bottom surface of the mounting substrate B is shown as being flush with the lower end of the first substrate 2, but the positional relationship between the mounting substrate B and the push switch 1 is not limited to the example illustrated in FIG. 2.

The first substrate 2 includes an insulating substrate portion 9 formed from a resin plate or the like, and a recess bonding sheet 10 which is formed with a circular or substantially rectangular aperture and which, when attached to the front surface of the insulating substrate portion 9, forms the accommodating recess 2*a*. The recess bonding sheet 10 is a double-faced bonding sheet, and the supporting sheet 6 is bonded to the front surface of the recess bonding sheet 10.

The movable contact spring 5 is formed from stainless steel or the like, more specifically, a two-sheet laminated spring having an arc-shaped cross section and designed to be elastically depressed with a reliable tactile feel when the pressing force being applied exceeds a given value.

The supporting sheet 6 is bonded to the recess bonding sheet 10 so as to cover the accommodating recess 2*a*. The supporting sheet 6 is a protective sheet formed from an insulating resin film such as polyimide, which also functions as a waterproof sheet and hermetically seals the accommodating recess 2*a* inside it. A protrusion 11 as an actuator formed in a disc shape from a rigid resin such as polyimide is provided on the surface of the supporting sheet 6 at a position corresponding to the crest of the movable contact spring 5.

The plate-like spacer 8 is formed from a resin plate such as polyphthalamide, and is bonded to the second substrate 7 by means of a spacer bonding sheet 25.

Figure 3:
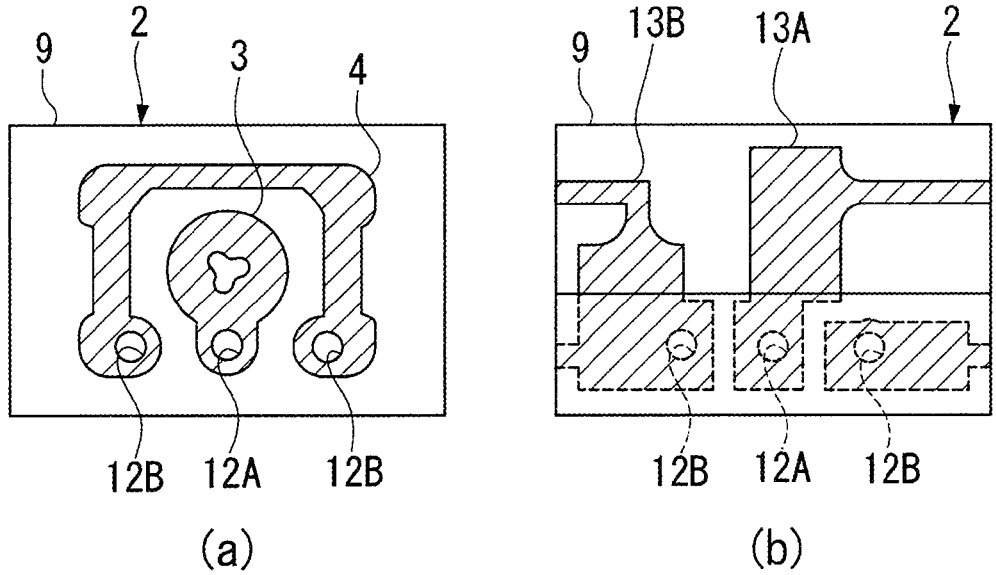
FIG. 3(*a*) is a diagram showing the front surface of a first substrate 2, and FIG. 3(*b*) is a diagram showing the back surface of the first substrate 2.

FIG. 3(*a*) is a diagram showing the front surface of the first substrate 2, and FIG. 3(*b*) is a diagram showing the back surface of the first substrate 2. The surface of the first substrate 2 on which the protrusion 11 is provided is designated as the front surface, and the surface of the first substrate 2 that faces the second substrate 7 is designated as the back surface.

The center contact 3 and the pair of peripheral contacts 4 are formed by patterning copper foil or the like on the bottom face of the accommodating recess 2*a*, as shown in FIG. 3(*a*). The center contact 3 is formed in a substantially circular shape in the center of the bottom face of the accommodating recess 2*a*. On the other hand, the peripheral contacts 4 are formed at the circumferential edges of the bottom face of the accommodating recess 2*a* in such a manner as to be symmetrical about the center contact 3, and are connected together at their ends so that the pair as a whole is formed in a U-shaped pattern.

As shown in FIG. 3(*b*), electrically conductive back surface patterns 13A and 13B are formed on the back surface of the first substrate 2. The back surface patterns 13A and 13B are formed by patterning copper foil or the like. A through-hole 12A is formed passing through the front and back surfaces of the first substrate 2, and one end is connected to the center contact 3, while the other end is connected to the back surface pattern 13A. Similarly, a through-hole 12B is formed passing through the front and back surfaces of the first substrate 2, and one end is connected to the peripheral contacts 4, while the other end is connected to the back surface pattern 13B. That is, the back surface pattern 13A is electrically connected via the through-hole 12A to the center contact 3 on the front surface. Likewise, the back surface pattern 13B is electrically connected via the through-hole 12B to the pair of peripheral contacts 4 on the front surface.

Figure 4:
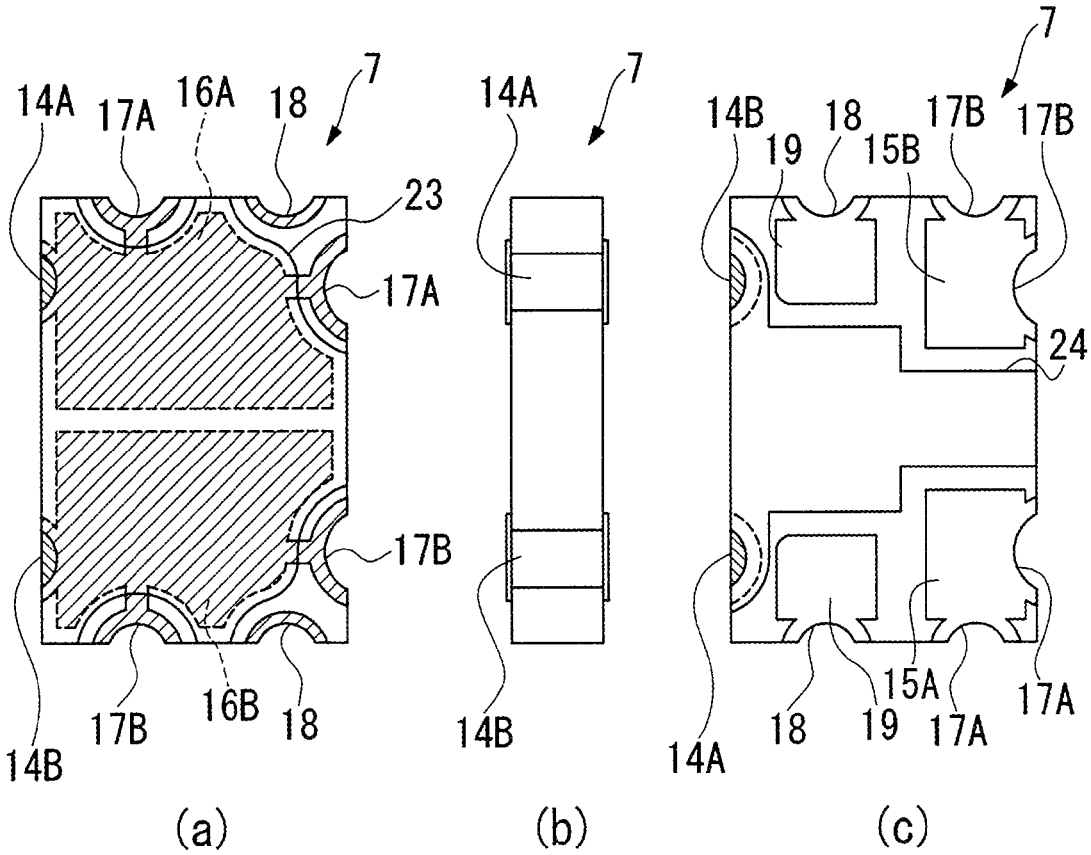
FIG. 4(*a*) is a diagram showing the front surface of a second substrate 7, FIG. 4(*b*) is a diagram showing the side face on the bonding side of the second substrate 7, and FIG. 4(*c*) is a diagram showing the back surface of the second substrate 7.

FIG. 4(*a*) is a diagram showing the front surface of the second substrate 7, FIG. 4(*b*) is a diagram showing the side face on the bonding side (the side facing the first substrate 2) of the second substrate 7, and FIG. 4(*c*) is a diagram showing the back surface of the second substrate 7. The surface of the second substrate 7 on which the plate-like spacer 8 is mounted is designated as the front surface, and the surface of the second substrate 7 that faces the mounting substrate B is designated as the back surface.

The second substrate 7 includes a pair of electrically conductive connection patterns 14A and 14B formed on the side face so as to make contact to both the front and back surfaces and so as to correspond with the back surface patterns 13A and 13B formed on the first substrate 2. A pair of electrically conductive front surface patterns 16A and 16B connected to the respective connection patterns 14A and 14B is formed on the front surface of the second substrate 7. Further, electrically conductive side face patterns 17A and 17B connected to the respective front surface patterns 16A and 16B are formed on side faces of the second substrate 7. A pair of electrode pads 15A and 15B connected to the respective side face patterns 17A and 17B is formed on the back surface of the second substrate 7. That is, on the second substrate 7, the connection patterns 14A and 14B are electrically connected to the respective electrode pads 15A and 15B.

As shown in FIG. 4(*a*), a surface resist 23 that covers the front surface patterns 16A and 16B is formed by patterning on the front surface of the second substrate 7 everywhere, except the front surface regions corresponding to the upper end portions of the connection patterns 14A and 14B, side face patterns 17A and 17B, and mounting patterns 18. Further, as shown in FIG. 4(*c*), a second back surface resist 24 that covers the lower end portions of the connection patterns 14A and 14B, as well as the portion between the electrode pads 15A and 15B and the center portion between mounting pads 19, is formed by patterning on the back surface of the second substrate 7 everywhere, except the regions corresponding to the electrode pads 15A and 15B and the mounting pads 19.

The second substrate 7 includes two mounting patterns 18 formed on the same side faces as the side face patterns 17A and 17B and electrically insulated from the other patterns, and two mounting pads 19 formed on the back surface and connected to the respective mounting patterns 18. The mounting pads 19 are provided not for providing electrical connections but for enhancing the bonding strength when the substrate is mounted on the mounting substrate B. It is therefore preferable to form the mounting pads 19 so as to be located closer to the side edges of the mounting substrate B than the electrode pads 15A and 15B.

The electrode pads 15A and 15B, the front surface patterns 16A and 16B, and the mounting pads 19 are respectively formed by patterning copper foil or the like. On the other hand, the connection patterns 14A and 14B are each formed by embedding a conductive paste, formed from a Cu-powder-containing epoxy resin or the like, into a channel of an arc-shaped cross section formed on the side face so as to contact both the front and back surfaces. Further, the side face patterns 17A and 17B and the mounting patterns 18 are each formed by forming a metal film along a channel of an arc-shaped cross section formed on the side face so as to contact both the front and back surfaces.

Figure 5:
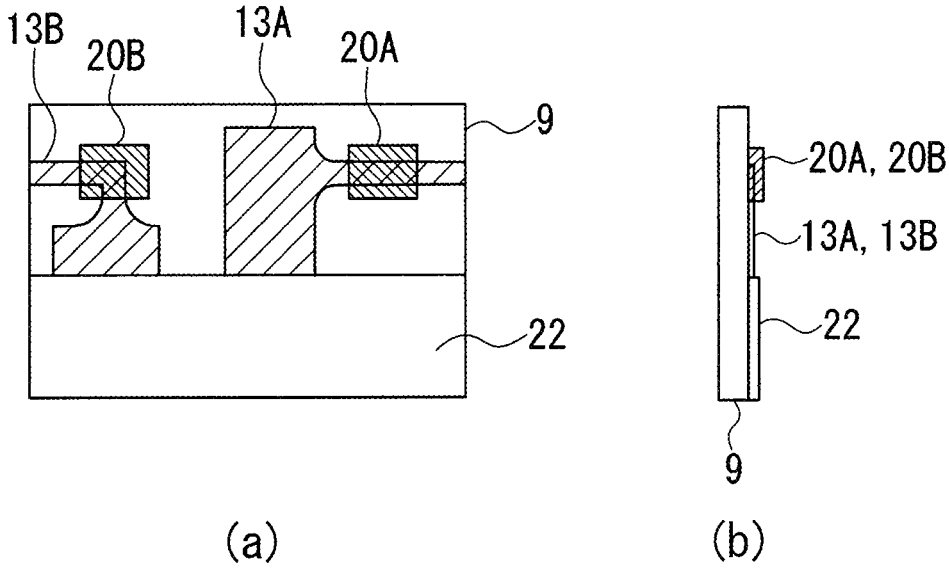
FIG. 5(*a*) is a diagram of the back surface showing an insulating substrate portion 9 on which conductive pastes are applied, and FIG. 5(*b*) is a side view of FIG. 5(*a*).

FIG. 5(*a*) is a diagram of the back surface showing the insulating substrate portion 9 on which conductive pastes are applied, and FIG. 5(*b*) is a side view of FIG. 5(*a*).

FIG. 5 shows the condition in which conductive pastes 20A and 20B are applied on the back surface patterns 13A and 13B, respectively, on the back surface of the insulating substrate portion 9 of the first substrate 2. Further, as shown in FIG. 5, a first back surface resist 22 that covers the through-holes 12A and 12B is formed by patterning on the back surface of the first substrate 2 everywhere, except the portion thereof to which the side face of the second substrate 7 is connected.

Figure 6:
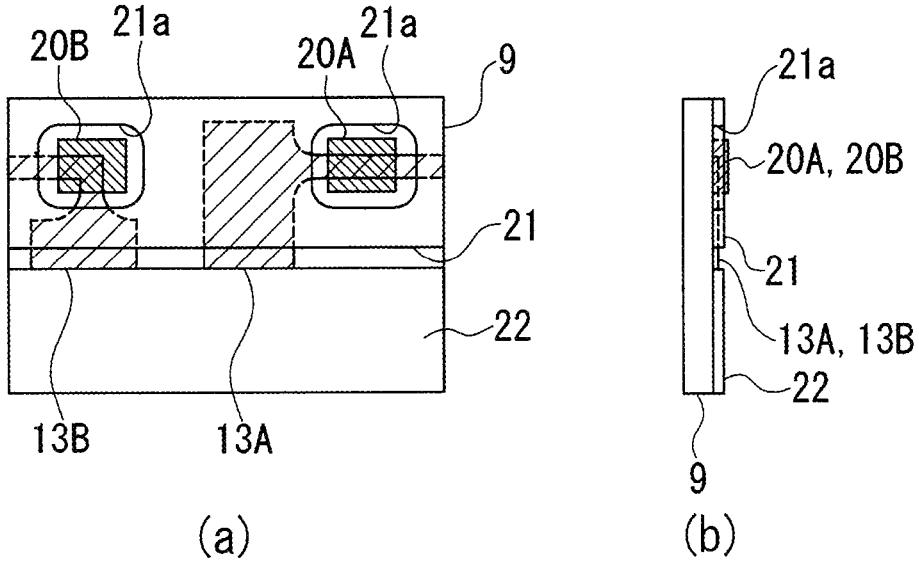
FIG. 6(*a*) is a diagram of the back surface showing the insulating substrate portion 9 to which a substrate bonding sheet is bonded, and FIG. 6(*b*) is a side view of FIG. 6(*a*).

FIG. 6(*a*) is a diagram of the back surface showing the insulating substrate portion 9 to which a substrate bonding sheet is bonded, and FIG. 6(*b*) is a side view of FIG. 6(*a*).

FIG. 6 shows the condition in which the substrate bonding sheet 21 is bonded on the back surface patterns 13A and 13B formed on the back surface of the insulating substrate portion 9 of the first substrate 2. The substrate bonding sheet 21 is formed with a pair of connection apertures 21*a* provided in corresponding fashion to the portions where the back surface patterns 13A and 13B are connected to the connection patterns 14A and 14B. The substrate bonding sheet 21 is a double-faced bonding sheet.

Figure 7:
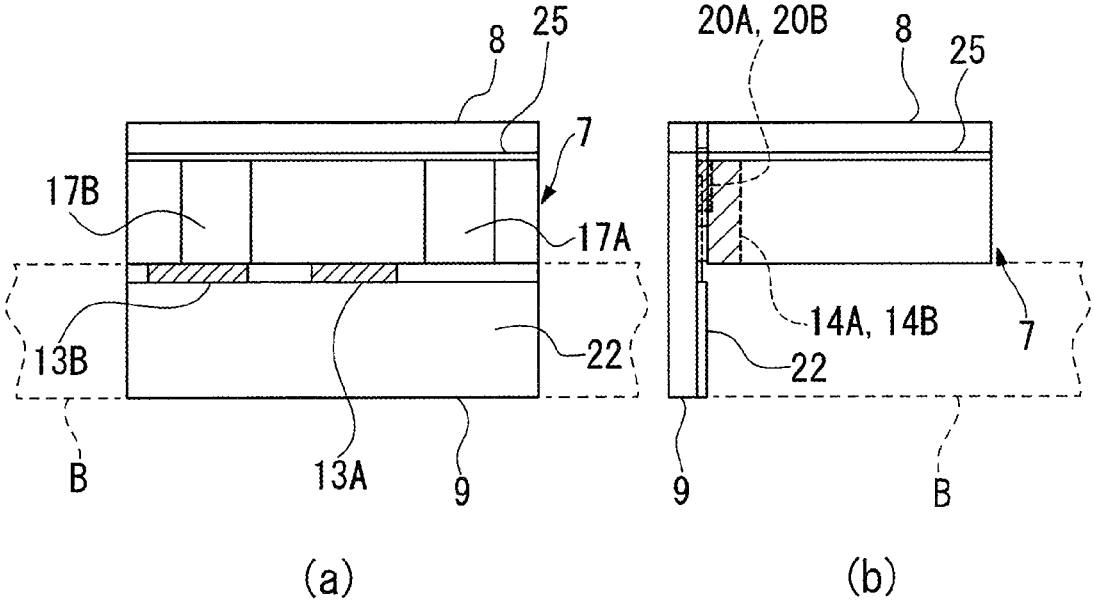
FIG. 7(*a*) is a diagram of the back surface showing the condition in which the second substrate 7 is bonded to the first substrate 2, and FIG. 7(*b*) is a side view of FIG. 7(*a*).

FIG. 7(*a*) is a diagram of the back surface showing the condition in which the second substrate 7 is bonded to the first substrate 2, and FIG. 7(*b*) is a side view of FIG. 7(*a*).

As shown in FIG. 7, the second substrate 7 is bonded to the first substrate 2 by means of the substrate bonding sheet 21. In this condition, the back surface patterns 13A and 13B are electrically connected to the connection patterns 14A and 14B via the conductive pastes 20A and 20B through the connection apertures 21*a* formed in the substrate bonding sheet.

The center contact 3 is electrically connected to the back surface pattern 13A via the through-hole 12A (see FIG. 3). The back surface pattern 13A is connected via the conductive paste 20A to the connection pattern 14A, and the connection pattern 14A is electrically connected via the front surface pattern 16A and the side face pattern 17A to the electrode pad 15A (see FIGS. 4 to 7). The peripheral contacts 4 are electrically connected to the back surface pattern 13B via the through-hole 12B (see FIG. 3). The back surface pattern 13B is connected via the conductive paste 20B to the connection pattern 14B, and the connection pattern 14B is electrically connected via the front surface pattern 16A and the side face pattern 17A to the electrode pad 15B (see FIGS. 4 to 7). Accordingly, when the first and second substrates 2 and 7 are bonded together to form a structure having an L-shaped cross section (see FIG. 7(*b*)), the center contact 3 and the peripheral contacts 4 are electrically connected via the through-holes 12A and 12B and the respective patterns to the electrode pads 15A and 15B that form the respective terminals.

As described above, in the push switch 1, the second substrate 7 is mounted perpendicular to the first substrate 2 by bonding the side face thereof to the back surface of the first substrate 2. When the second substrate 7 is bonded to the first substrate 2, the first and second substrates 2 and 7 form an integral structure having an L-shaped cross section. Further, the back surface patterns 13A and 13B on the first substrate 2 are electrically connected to the pair of electrode pads 15A and 15B on the second substrate 7 via the pair of electrically conductive connection patterns 14A and 14B formed on the side face of the second substrate 7. By employing the above structure, the first and second substrates 2 and 7 can each be formed using a conventional printed circuit board (PCB), which not only facilitates the construction of a thin structure but also makes it possible to reduce the overall cost.

In the push switch 1, the electrical connections between the first and second substrates 2 and 7 are made via the through-holes 12A and 12B, the back surface patterns 13A and 13B, the connection patterns 14A and 14B, and the electrode pads 15A and 15B. Accordingly, compared with the prior art method that provides electrical connections by insert-molded metal parts, the electrical connection method according to the present invention can enhance mass-producibility while achieving further reductions in size and thickness. Furthermore, the electrical connection method according to the present invention can achieve higher stiffness than in the case of the FPC or the like, and can provide higher strength with respect to the switch pressing force.

In the push switch 1, the second substrate 7 is bonded to the first substrate 2 via the substrate bonding sheet 21 that is formed with the connection apertures 21*a* and that is provided where the back surface patterns 13A and 13B are connected to the connection patterns 14A and 14B. Thus, the presence of the substrate bonding sheet 21 not only serves to further enhance the adhesion between the regions around the connecting portions, but also provides waterproof sealing to the electrical connection portions between the first and second substrates 2 and 7.

Further, in the push switch 1, since the plate-like spacer 8 is provided on the second substrate 7, the switch height can be changed by changing the thickness of the second substrate 7 and/or the plate-like spacer 8, and it thus becomes possible to readily address various needs for the switch height. Conversely, the switch height can be held substantially constant at the desired value regardless of the thickness of the mounting substrate B. In either case, it is preferable to adjust the placement so that the surface of the plate-like spacer 8 is flush with the side face of the first substrate 2.

Furthermore, in the push switch 1, since the protrusion 11 is provided on the surface of the supporting sheet 6 at the position corresponding to the crest of the movable contact spring 5, the center of the movable contact spring 5 can always be pressed in a reliable manner, which not only provides a stable operating feel but also serves to prolong the service life. Accordingly, the push switch 1 can achieve performance (operating characteristics and service life) comparable to that of a surface-mounted switch, though it is a side-mounted switch. Further, since the push switch 1 is constructed so that a portion of the mounting substrate B is located just to the right of the protrusion 11 when viewed in the direction C in which the protrusion 11 is pressed (see FIG. 2), the force applied to press the protrusion 11 is received by the mounting substrate B. With this structure, the push switch 1 can provide a stable pressing feel.

In the push switch 1 described above, the accommodating recess 2*a* is formed by bonding the recess bonding sheet 10 onto the insulating substrate portion 9 (see FIG. 2). However, rather than using the recess bonding sheet 10, a circular recess (accommodating recess) may be formed directly in the insulating substrate portion 9, and the supporting sheet 6 may be attached by means of adhesive or the like directly to the front surface of the insulating substrate portion 9.

DESCRIPTION OF THE REFERENCE NUMERALS

1 . . . PUSH SWITCH
2 . . . FIRST SUBSTRATE
2*a* . . . ACCOMMODATING RECESS
3 . . . CENTER CONTACT
4 . . . PERIPHERAL CONTACT
5 . . . MOVABLE CONTACT SPRING
6 . . . SUPPORTING SHEET
7 . . . SECOND SUBSTRATE
8 . . . PLATE-LIKE SPACER
11 . . . PROTRUSION
12A, 12B . . . THROUGH-HOLE
13A, 13B . . . BACK SURFACE PATTERN
14A, 14B . . . CONNECTION PATTERN
15A, 15B . . . ELECTRODE PAD
21 . . . SUBSTRATE BONDING SHEET
21*a* . . . CONNECTION APERTURE

What is claimed is:

1. A push switch comprising:

a first substrate having an accommodating recess on a front surface thereof;

a center contact provided so as to be substantially centralized in said accommodating recess;

a pair of peripheral contacts each provided at a circumferential edge of said accommodating recess;

a movable contact spring constructed so as to extend across said pair of peripheral contacts and designed to be brought into contact with said center contact when pressed; and a second substrate having a pair of connection pads electrically connected to said first substrate, wherein said first substrate and said second substrate are formed as an integral structure so as to provide an L-shaped cross section, said first substrate has a pair of electrically conductive back surface patterns on a back surface thereof, said center contact is electrically connected to one of said pair of back surface patterns, said pair of peripheral contacts is connected to the other one of said pair of back surface patterns, said second substrate has a pair of electrically conductive connection patterns on a side face thereof for connecting to said pair of back surface patterns formed on said first substrate, and a pair of connection pads each electrically connected to a corresponding one of said pair of electrically conductive connection patterns, and said first substrate and said second substrate are bonded together by bonding said back surface of said first substrate to said side face of said second substrate to form said integral structure having said L-shaped cross section, and said integral structure is mounted on a side edge of a mounting substrate.

2. The push switch according to claim 1, further comprising a substrate bonding sheet interposed between said first substrate and said second substrate, wherein said substrate bonding sheet includes connection apertures provided in corresponding fashion to portions where said pair of back surface patterns on said first substrate is connected to said pair of electrically conductive connection patterns on said second substrate.

3. The push switch according to claim 1, further comprising a thickness adjusting plate-like spacer which is bonded to said second substrate and whose surface height is adjusted so as to achieve a surface flush with a side face of said first substrate.

4. The push switch according to claim 1, further comprising:

a flexible supporting sheet bonded to said first substrate so as to close an opening of said accommodating recess; and a protrusion provided on a front surface of said supporting sheet at a position corresponding to a crest of said movable contact spring.

* * * * *